US006266833B1

(12) United States Patent
Lin

(10) Patent No.: US 6,266,833 B1
(45) **Date of Patent: *Jul. 31, 2001**

(54) AIR BED STRUCTURE CAPABLE OF ALTERNATE AERATING AND LYING THEREON ON ONE'S SIDE

(76) Inventor: Joenne Lin, No.81, Rong Xing Street, Ping Zhen City, Tao Yuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/336,347

(22) Filed: Jun. 18, 1999

(30) Foreign Application Priority Data

Oct. 9, 1998 (TW) ..... 87216746

(51) Int. Cl.[7] ..... A47C 27/10

(52) U.S. Cl. ..... 5/713; 5/710; 137/625.21

(58) Field of Search ..... 5/713, 710, 706, 5/715, 654, 655.3; 137/625.21, 596.17

(56) References Cited

U.S. PATENT DOCUMENTS

| | | | | |
|---|---|---|---|---|
| 3,388,701 | * | 6/1968 | Schreiber et al. | 137/624.14 X |
| 3,462,778 | * | 8/1969 | Whitney | 5/713 |
| 3,656,190 | * | 4/1972 | Regan et al. | 5/713 X |
| 3,678,520 | * | 7/1972 | Evans | 5/713 |
| 3,919,730 | * | 11/1975 | Regan | 5/710 |
| 4,197,837 | * | 4/1980 | Tringali et al. | 5/713 X |
| 4,225,989 | * | 10/1980 | Corbett et al. | 5/713 |
| 4,622,706 | * | 11/1986 | Takeuchi | 5/713 |
| 4,825,486 | * | 5/1989 | Kimura et al. | 5/713 |
| 4,949,414 | * | 8/1990 | Thomas et al. | 5/713 |
| 5,035,016 | * | 7/1991 | Mori et al. | 5/713 |
| 5,052,067 | * | 10/1991 | Thomas et al. | 5/713 |
| 5,109,561 | * | 5/1992 | Schild | 5/713 |
| 5,117,518 | * | 6/1992 | Schild | 5/713 |
| 5,193,237 | * | 3/1993 | Holdredge | 5/654 |
| 5,379,471 | * | 1/1995 | Holdredge | 5/655.3 |
| 5,533,217 | * | 7/1996 | Holdredge | 5/713 X |
| 5,920,934 | * | 7/1999 | Hannagan et al. | 137/625.21 X |
| 6,058,538 | * | 5/2000 | Chapman et al. | 5/713 |
| 6,108,843 | * | 8/2000 | Suzuki et al. | 5/713 |

FOREIGN PATENT DOCUMENTS

| | | | | |
|---|---|---|---|---|
| 2134382 | * | 8/1984 | (DE) | 5/713 |

* cited by examiner

*Primary Examiner*—Anthony Knight
*Assistant Examiner*—Robert G. Santos
(74) *Attorney, Agent, or Firm*—Pro-Techtor International Services

(57) ABSTRACT

An air bed structure capable of alternate aerating and lying thereon on one's side, wherein, the air bed is divided into a right and a left part each being comprised of a plurality of elongate air bladders in several sets or groups. Air bladders of each set are communicated with one another. The air bladders in each side both are alternately arranged mutually to cooperate with two air valves of specific design, a plurality of pipe lines and a controlling electronic circuit to provide various aeration states of complete aeration, first one-side aeration, second one-side aeration, first alternate aeration, second alternate aeration etc. Thereby a patient lying on the air bed can adjust the aeration state of the air bed in pursuance of requirement. This is extremely ideal and convenient for patients and old people.

2 Claims, 17 Drawing Sheets

AIR BED STRUCTURE CAPABLE OF ALTERNATE AERATING AND LYING THEREON ON ONE'S SIDE

BACKGROUND OF THE INVENTION

1. Field of the Invention

The present invention is related to an air bed structure capable of alternate aerating and lying thereon on one's side. And especially to an air bed structure of which the aeration function can include the multiple styles such as complete aeration, first one-side aeration, second one-side aeration, first alternate aeration, second alternate aeration etc.

2. Description of the Prior Art

A serious ill patient generally needs lying on a bed for several decades of days, several years or for the whole life long. Lying for years on a bed makes him contact the mattress with his back and buttocks, the skins on these areas will get decubitus by long pressing and bad aeration, and getting rotten skin is the worse. In view of this, the art of medical instrument has had studied and developed air beds which are capable of separate aeration and discharging, in order that time of being pressed of skins may be reduced as much as possible. However, conventional air beds only has too simple function to satisfy the patients' requirement by virtue that an air bed is divided only into several air bladders which are alternately aerated and discharged.

SUMMARY OF THE INVENTION

In view of the non-ideally practical function of the conventional air beds, the inventor studied and develops the present invention to provide an ideal and practical air bed with its novel structure as well as effect for the patients lying long thereon.

The direct object of the present invention is to provide an air bed structure capable of alternate aerating and lying thereon on one's side. Wherein, the air bed is divided into a right and a left side part (which each includes several air bladders) except an elongate air bladder used as a protection cushion or a bottom cushion. Air bladders of each part are divided into several sets which are alternately arranged relative to each other. Air bladders of each set are communicated with one another. In this way, two air valves with unique structural design and with unique piping arrangement as well as electronic control are provided to render the air bladders of the air bed to have the novel function of complete aeration, first alternate aeration, second alternate aeration, and especially, first one-side aeration and second one-side aeration etc. Thereby, with the present invention, an object of lying on the air bed on one's side can be achieved.

Following the above stated direct object, the present invention can have the indirect objects as stated below:

1. As for a patient or an old person lying on the air bed for a long period, the function of lying on the air bed on one's side (right side or left side) can get rid of dullness and boringness induced when he can only lie on his back to see the ceiling, and can enlarge his field of view to make more pleasure as to his emotion psychologically.

2. As for a patient with drowned lungs, by virtue that the present invention allows lying on the air bed on one's side, water in the lungs can be made shaking timely to lower propagation rate of germs and thus to avoid rapid propagation of germs due to unmoving for a long time (this is like the way that mosquitoes propagate in a vessel with water).

3. As for a patient being subjected to getting phlegm and pus in his respiratory organ, by virtue that the present invention allows lying on the air bed on one's side, rate of suffocation by over amount of phlegm and pus can be lowered.

4. As for a patient being in need of changing dressing of a wound or in need of patting his back, a nurse can change dressing of the wound or pat his back easily after lying on one side of the patient on the bed. This can reduce inconvenience and suffering of body weight.

The present invention will be apparent in its composition of structure and the effect created after reading the detailed description of the preferred embodiment thereof in reference to the accompanying drawings.

DETAILED DESCRIPTION OF THE PREFERRED EMBODIMENT

Figure 1:
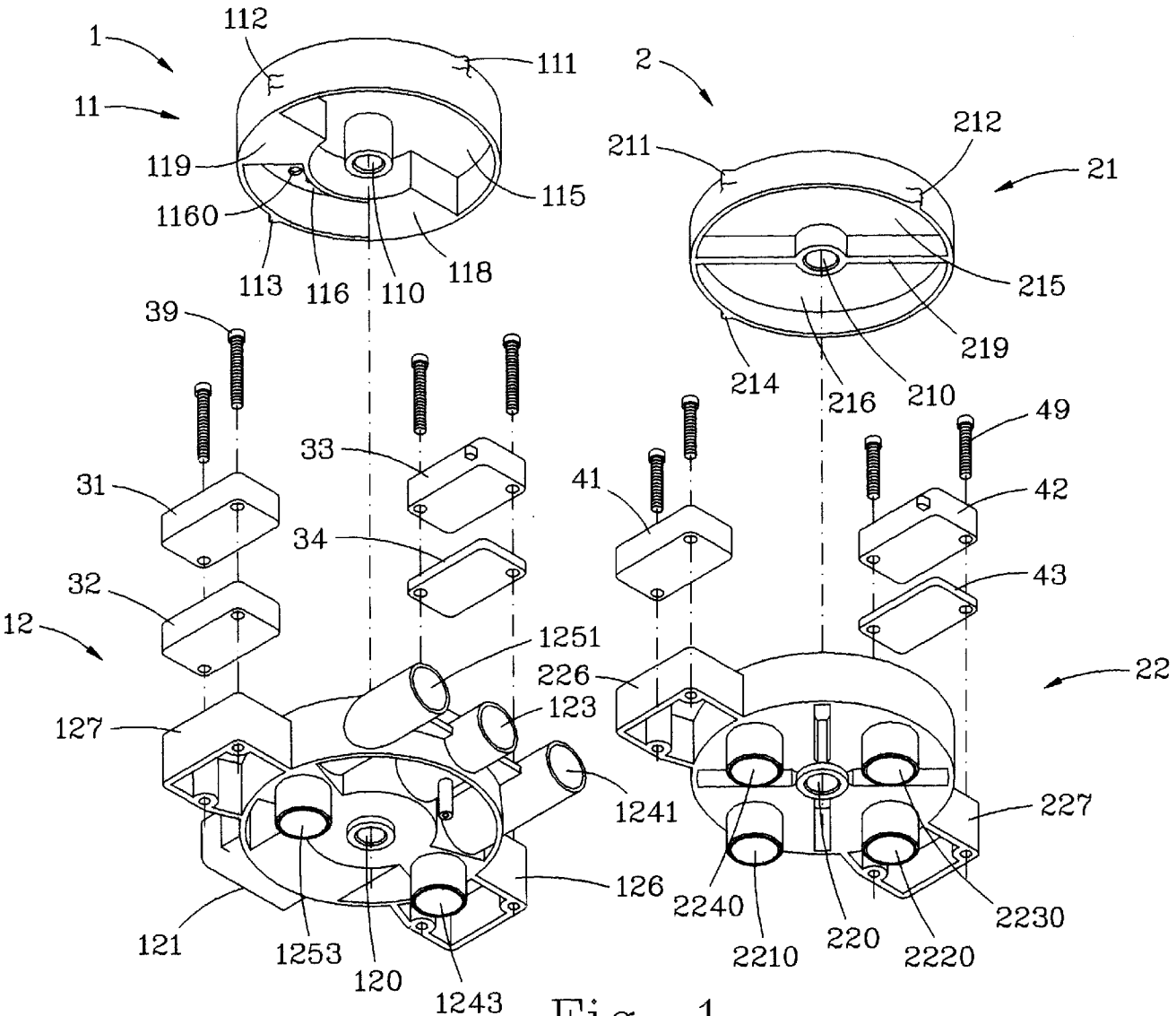
FIG. 1 is an analytic perspective view of two air valves of the present invention.
Figure 2:
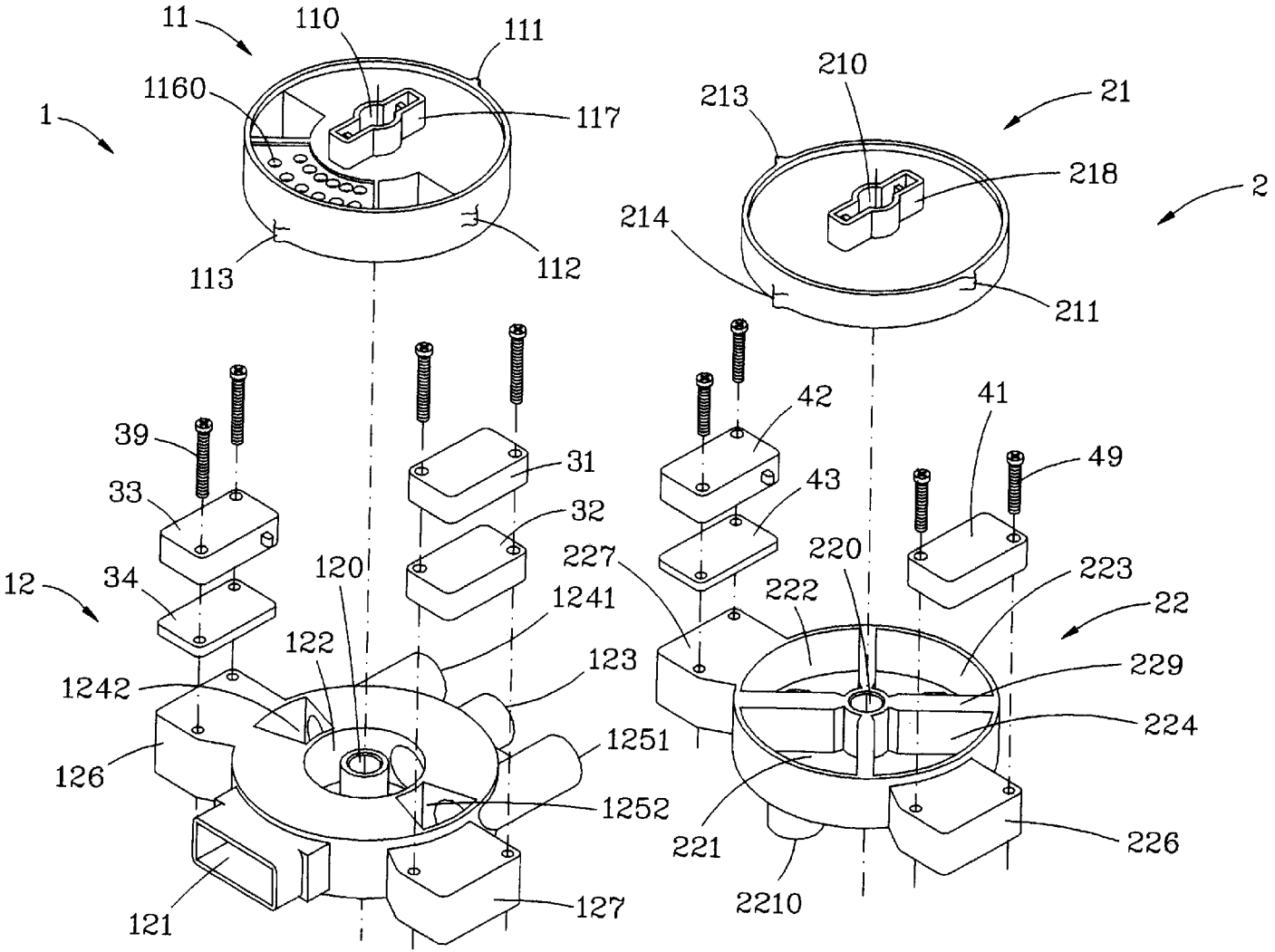
FIG. 2 is another analytic perspective view of two air valves of the present invention.
Figure 3:
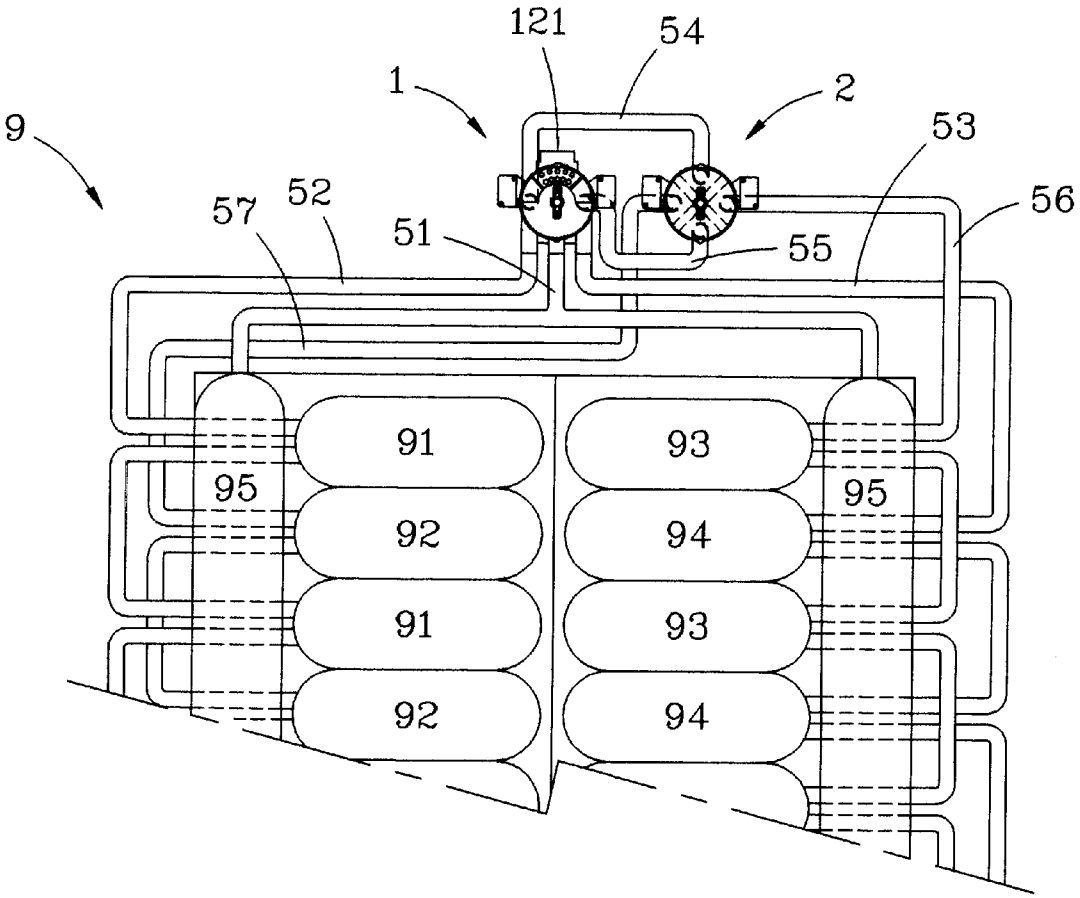
FIG. 3 is a schematic view showing connection of the two air valves and the air bed of the present invention.

Referring to FIG. 1, 2 and 3, the present invention is comprised mainly of a first air valve 1, a second air valve 2 and an air bed 9. By controlling aeration of the first air valve I and the second air valve 2, various states of aeration and discharging of the air bed 9 can be provided.

Wherein, the first air valve 1 is comprised of an upper rotation lid 11 and a lower seat 12, the upper rotation lid 11 is mounted on the lower seat 12. The upper rotation lid 11 and the lower seat 12 are provided at the centers thereof respectively with a through hole 110 and a through hole 120. A driving structure 117 is provided on the top of the upper rotation lid 11, thereby, an external motor (not shown) can drive the upper rotation lid 11 to rotate, while the lower seat 12 maintains unmoved. The top surface of the upper rotation lid 11 is a sealed surface; a big air chamber 115 and a small air chamber 116 are formed beneath the top surface. Area of the big air chamber 115 is larger than that of the small air chamber 116; a block 119 and a block 118 are provided between them. The top of the small air chamber 116 is provided with a plurality of discharge holes 1160. The upper rotation lid 11 is provided on the external annular wall thereof with four lugs 111, 112, 113 and 114 separated one from the next by an angle of about 90 degrees, the lugs 111, 112, 113 and 114 are not exactly at the same level relatively. The lower seat 12 is in the form quite similar to the upper rotation lid 11, it is provided on the wall appropriately at its lateral side with a transverse main intake 121. The lower seat 12 is provided beneath the top surface thereof with an annular air chamber 122 which is communicated with the transverse main intake 121. A transverse central discharge pipe 123 is provided on the external wall of the lower seat 12 opposite to the transverse main intake 121 and is communicated with the annular air chamber 122. In other words, the transverse main intake 121 is communicated with the transverse central discharge pipe 123. The transverse central discharge pipe 123 is provided at the two sides thereof with an air pipe 1251 and an air pipe 1241. While the annular air chamber 122 is provided at the two sides thereof with an air chamber 1252 and an air chamber 1242 which are opened on their tops. The air chamber 1252 and the air chamber 1242 are provided on the bottoms thereof respectively with a vertical lower air pipe 1253 and a vertical lower air pipe 1243 communicating respectively with the interiors of the air pipe 1251 and the air pipe 1241. The air chamber 1252 and the air chamber 1242 of the lower seat 12 are provided respectively at the outer lateral sides thereof with a receiving seat 126 and 127 for mounting therein respectively two micro-switches 31, 32 as well as a micro-switch 33 and a pad 34 by a plurality of screws 39.

The second air valve 2 is comprised of an upper rotation lid 21 and a lower seat 22, the upper rotation lid 21 is mounted on the lower seat 22. The upper rotation lid 21 and the lower seat 22 are provided at the centers thereof respectively with a through hole 210 and a through hole 220. A driving structure 218 is provided on the top of the upper rotation lid 21, thereby, an external motor (not shown) can drive the upper rotation lid 21 to rotate, while the lower seat 22 maintains unmoved. The top surface of the upper rotation lid 21 is a sealed surface; an air chamber 215 and an air chamber 216 are formed beneath the top surface. Area of the air chamber 215 is similar to that of the air chamber 216; a block 219 is provided between them. The upper rotation lid 21 is provided on the external annular wall thereof with four lugs 211, 212, 213 and 214 separated one from the next by an angle of about 90 degrees, the lugs 211, 212, 213 and 214 are not exactly at the same level relatively. The lower seat 22 is in the form quite similar to the upper rotation lid 21; the bottom thereof is a sealed surface; the top thereof is divided into a first air chamber 221, a second air chamber 222, a third air chamber 223 and a fourth air chamber 224 separated by a cross shaped partition plate 229. The bottoms of these air chambers 221, 222, 223 and 224 are provided respectively vertically with a first air pipe 2210, a second air pipe 2220, a third air pipe 2230 and a fourth air pipe 2240. The second air chamber 222 and the fourth air chamber 224 of the lower seat 22 are provided respectively at the outer lateral sides thereof with a receiving seat 226 and 227 for mounting therein respectively a micro-switch 41 as well as a micro-switch 42 and a pad 43 by a plurality of screws 39. In the present invention, any micro-switch (31, 32, 33; and 41, 42) contacting with a corresponding lug (111, 112, 113 and 114; 211, 212, 213 and 214) at the same level will make turning off of its corresponding motor to stop rotation of its corresponding upper rotation lid (11, 21).

The air bed 9 is comprised of a plurality of elongate air bladders 91, 92, 93, 94 and 95. Wherein, the elongate air bladders 91 and 92 are provided on the same side, while elongate air bladders 93 and 94 are provided on the same other side. The elongate air bladders 91 and 92 are alternately arranged mutually; the elongate air bladders 93 and 94 are alternately arranged mutually too. The elongate air bladder 95 extends to both sides of the whole of the elongate air bladders 91, 92, 93 and 94 and is at a level higher than that of the elongate air bladders 91, 92, 93 and 94. The elongate air bladder 95 is used as a protection cushion (or can be extended to the ground as a bottom cushion) to prevent a patient from dropping off the air bed 9.

Terminology of the functions of the air bed 9 is listed below in the first place:

Complete aeration: the air bladders 91, 92, 93 and 94 are all aerated.

First one-side aeration: the air bladders 91 and 92 are aerated, while the air bladders 93 and 94 are discharged, now a person can lie on one side of him on the bed.

Second one-side aeration: the air bladders 93 and 94 are aerated, while the air bladders 91 and 92 are discharged, now a person can lie on the other side of him on the bed.

First alternate aeration: the air bladders 91 and 93 are aerated, while the air bladders 92 and 94 are discharged, now a person lying on the bed can have less contact area with the bed.

Second alternate aeration: the air bladders 91 and 93 are discharged, while the air bladders 92 and 94 are aerated, now a person lying on the bed can have less contact area with the bed too.

The above stated functions are described now referring to the connections shown in FIG. 3 of the drawings: The main intake 121 is connected to an external air supply pump (not shown); the central discharge pipe 123 is connected to the elongate air bladder 95 via a pipe line 51; the air pipe 1251 is connected to the air bladders 91 via a pipe line 52; the vertical lower air pipe 1253 is connected to the first air pipe 2210 of the first air chamber 221 via a pipe line 54; the lower air pipe 1243 is connected to the third air pipe 2230 of the third air chamber 223 via a pipe line 55; the second air pipe 2220 of the second air chamber 222 is connected to the air bladders 93 via a pipe line 56; and the fourth air pipe 2240 of the fourth air chamber 224 is connected to the air bladders 92 via a pipe line 57.

It shall be explained in the first place that, when the main intake 121 intakes air, air can be delivered to the central discharge pipe 123 via the annular air chamber 122 to aerate the air bladder 95. The air bladder 95 is always aerated in operation of the present invention. The present invention further includes external electronic circuit soft and hardwares to appropriately control rotation and rotating time of the upper rotation lids 11, 21.

Figure 4:
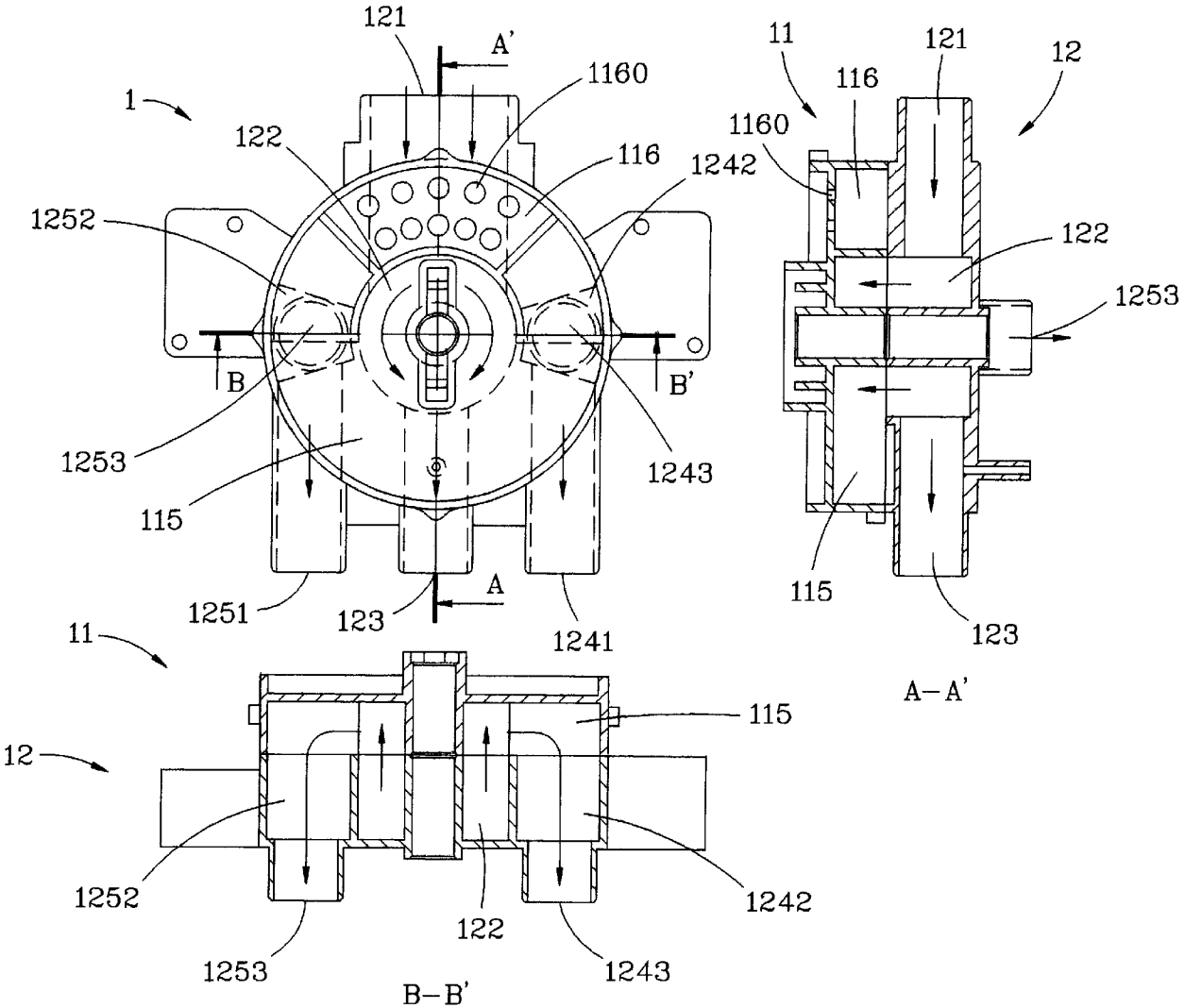
FIG. 4 is a schematic view showing the state of the first air valve in a complete aeration of the air bed of the present invention.
Figure 5:
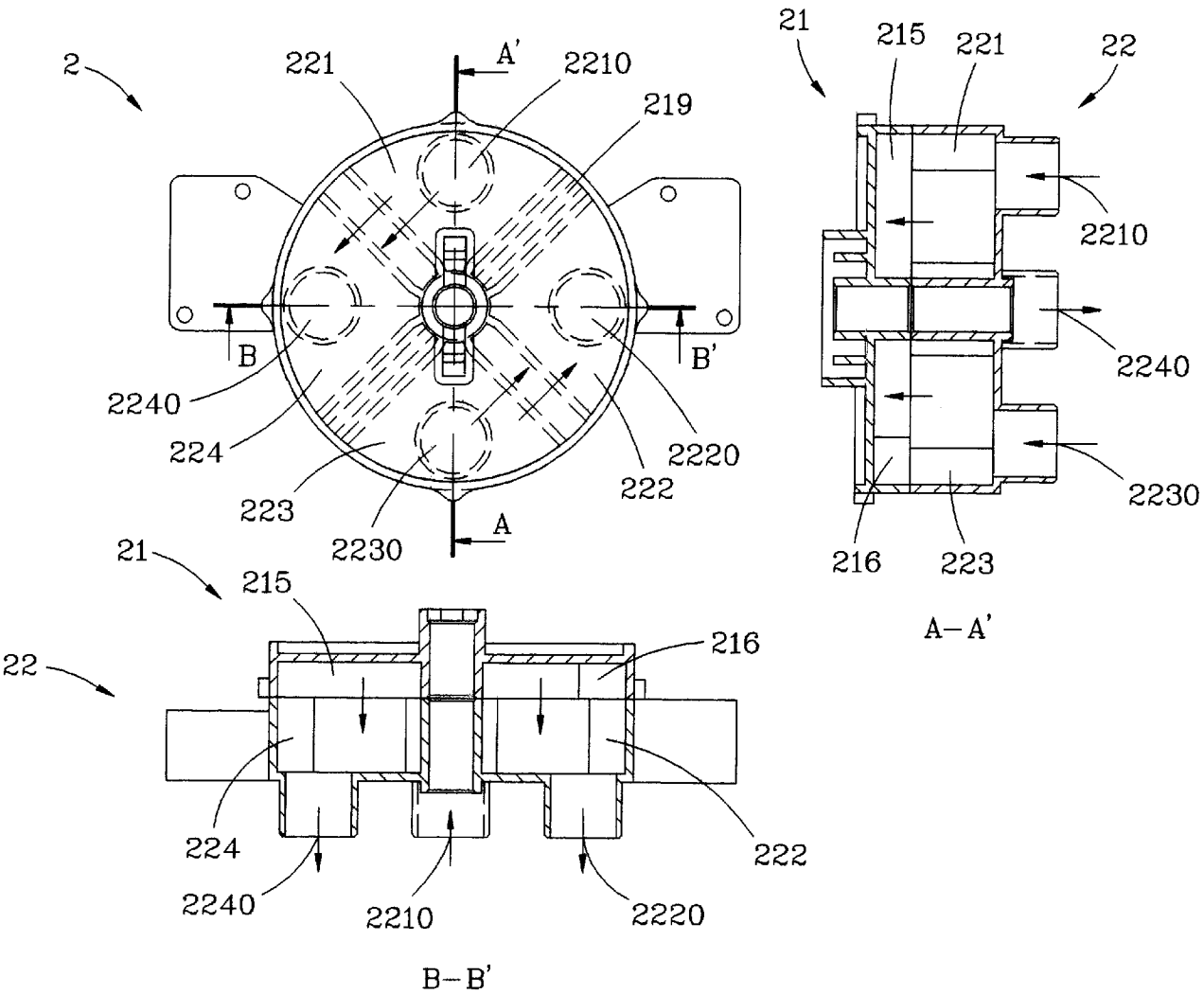
FIG. 5 is a schematic view showing the state of the second air valve in the complete aeration of the air bed of the present invention.
Figure 6:
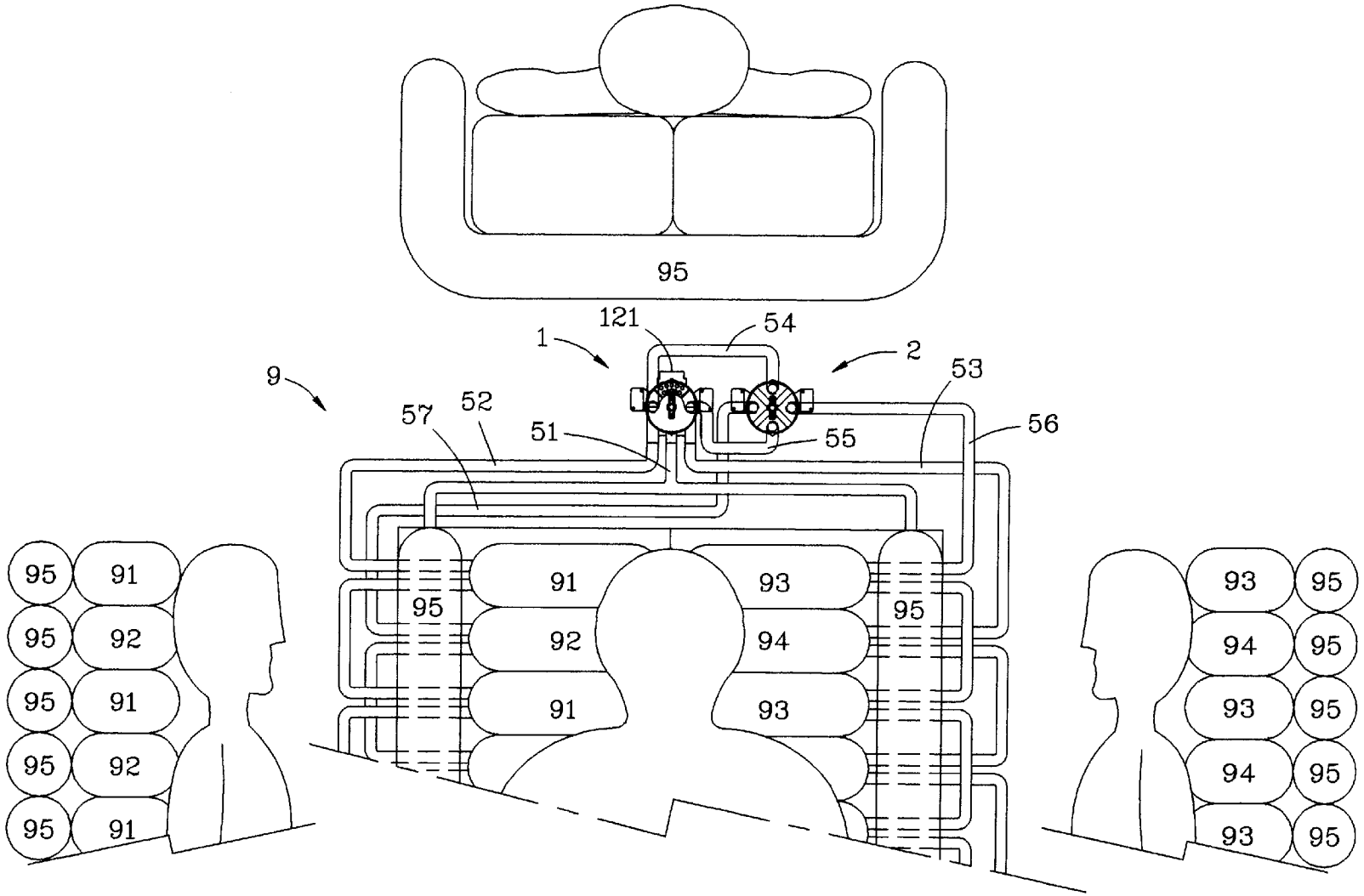
FIG. 6 is a schematic view showing the state of the air bed in the complete aeration of the air bed of the present invention.

When it is desired to provide the air bed with a complete aeration state: Referring to FIG. 4, when the main intake 121 intakes air, air can be delivered to the central discharge pipe 123 via the annular air chamber 122 to aerate the air bladder 95. Air is now divided to flow to the air chambers 1252 and 1242 to give air to the air pipes 1251 and 1241. Therefore, the air bladders 91 and 94 are aerated. On the other hand, the air chambers 1252 and 1242 obtain air to thereby give air to the lower air pipes 1253 and 1243. Therefore, the pipe lines 54, 55 and in turn the first air chamber 221 and the third air chamber 223 obtain air (as shown in FIG. 5). Air is led to the second air chamber 222 and the fourth air chamber 224 via the upper rotation lid 21 of the second air valve 2. The pipe lines 56, 57 are aerated, thereby the air bladders 92 and 93 are aerated. Now all the air bladders 91, 92, 93 and 94 are aerated (as shown in FIG. 6).

Figure 7:
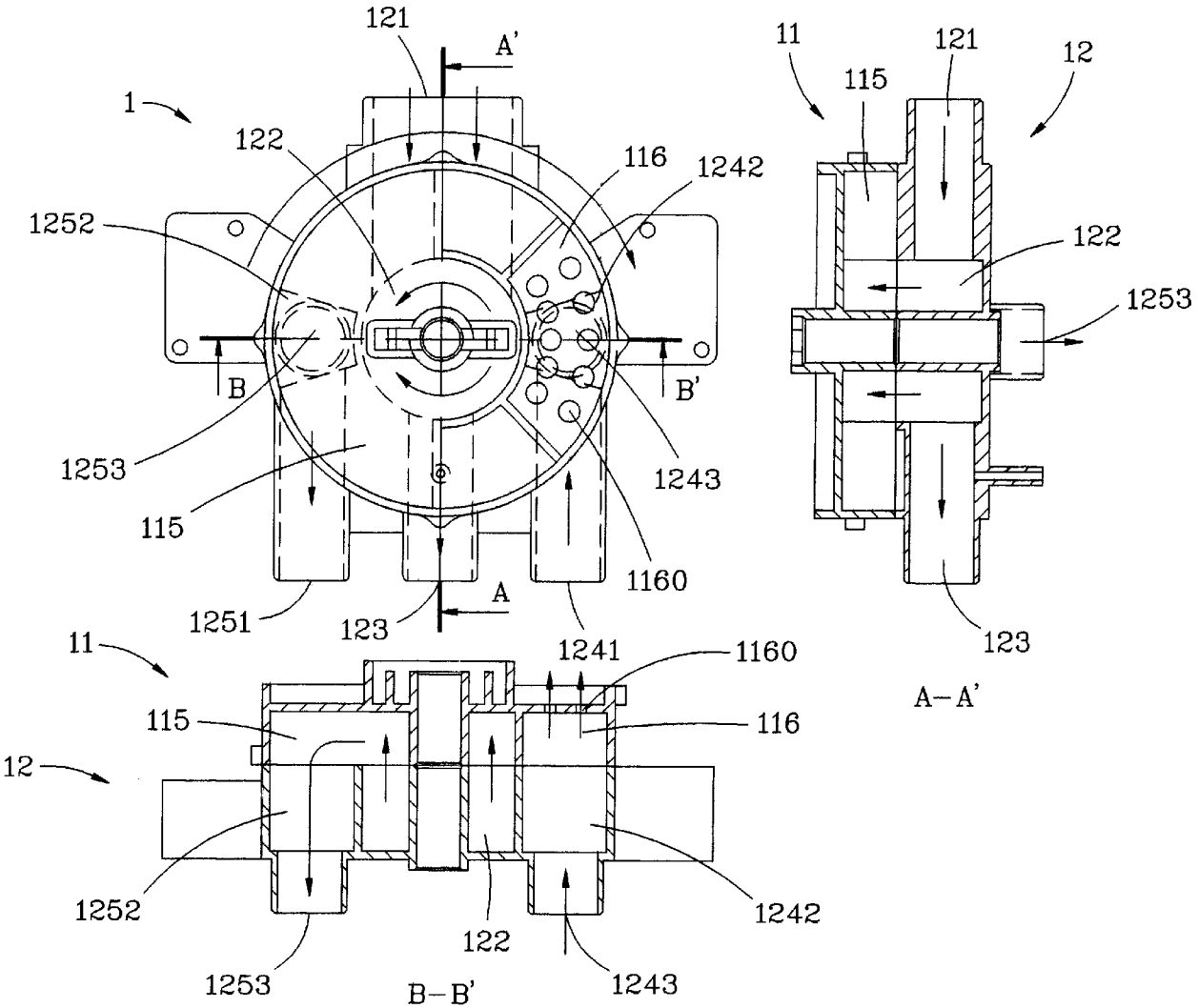
FIG. 7 is a schematic view showing the state of the first air valve in discharging of an air pipe (1241) of the air bed of the present invention.
Figure 8:
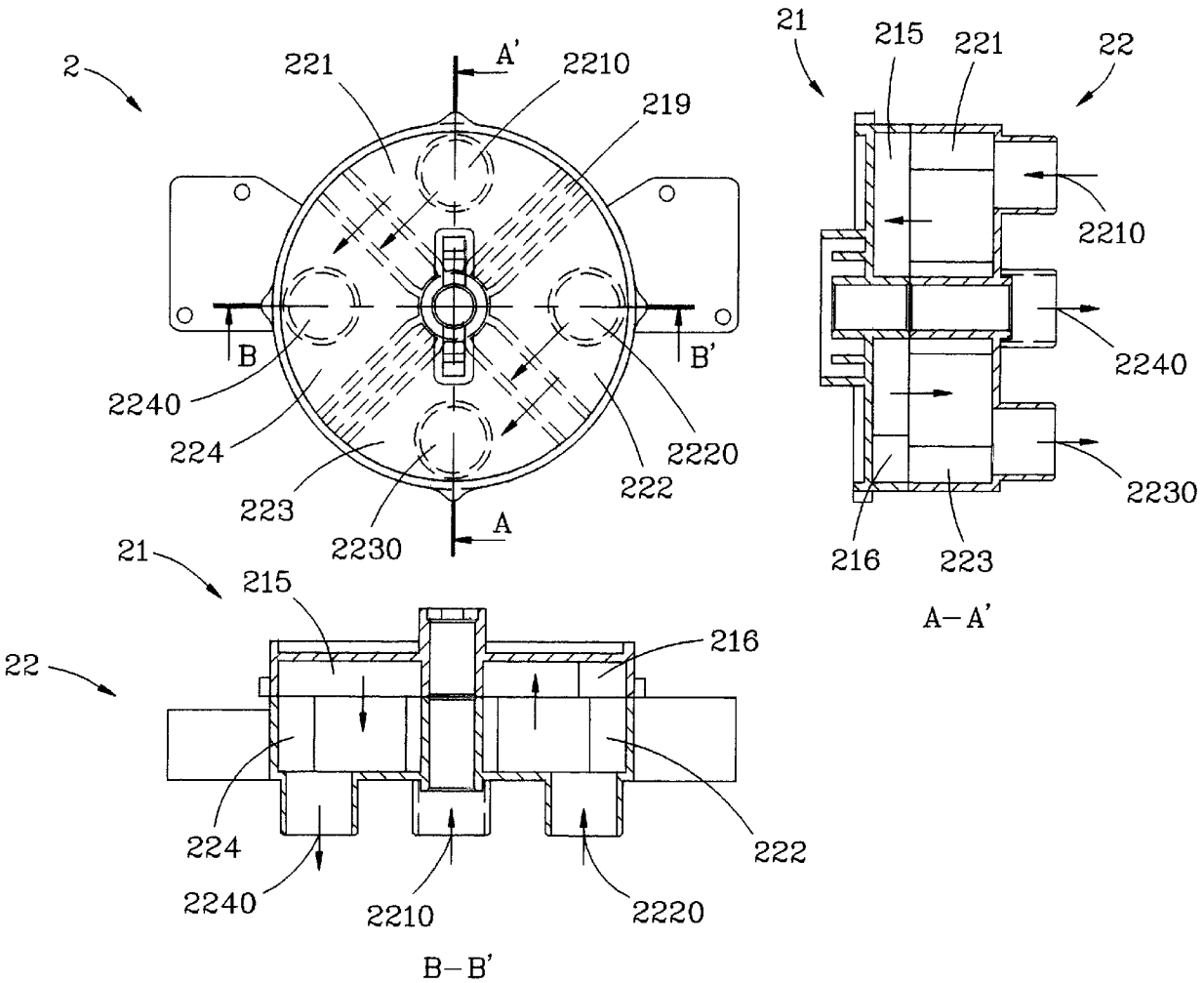
FIG. 8 is a schematic view showing the state of the second air valve in a first one-side aeration of the air bed of the present invention.
Figure 9:
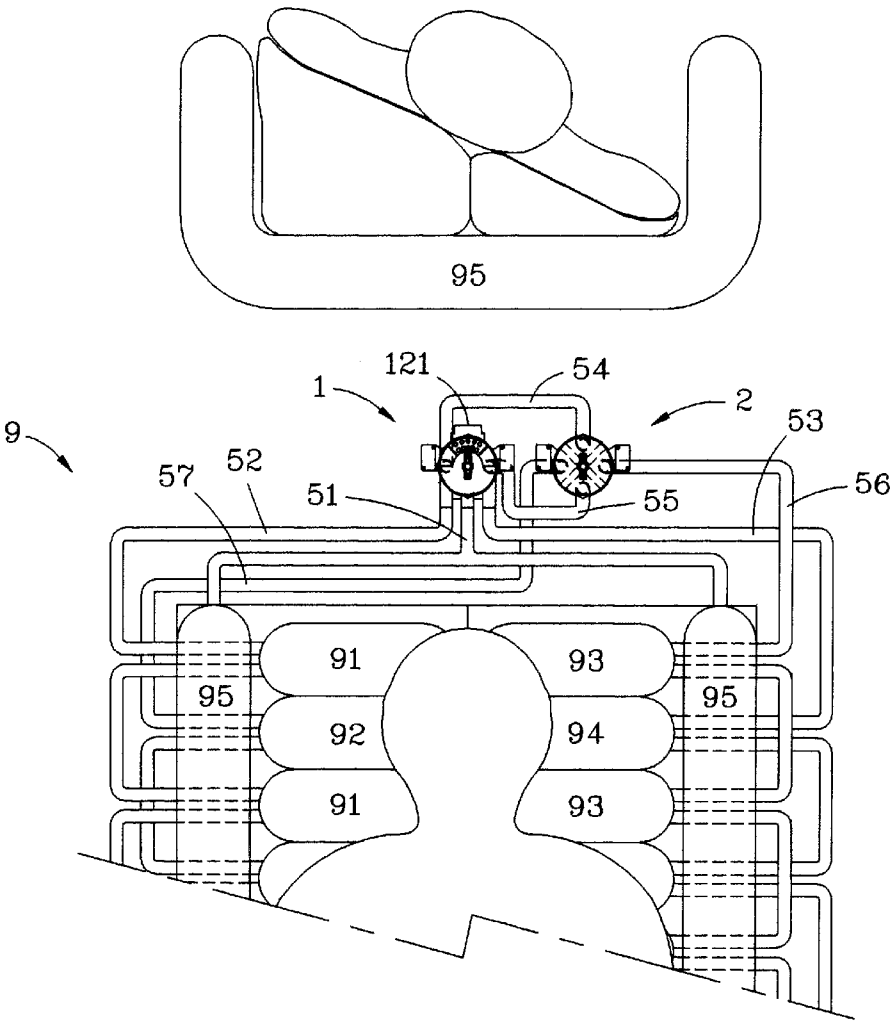
FIG. 9 is a schematic view showing the state of the air bed in the first one-side aeration of the air bed of the present invention.

When it is desired to provide the air bed with the first one-side aeration state: Referring to FIG. 7, 8 and 9, to get the state as shown in FIG. 9, the air bladders 91, 92 shall be aerated, while the air bladders 93, 94 are not aerated. In this way, air is taken in from the main intake 121, and fills the annular air chamber 122, the central discharge pipe 123 and the air bladder 95. The air flows respectively into the air pipe 1251 and the lower air pipe 1253. The part flowing into the air pipe 1251 goes through the pipe line 52 to the air bladder 91. The part flowing into the air pipe 1253 goes through the pipe line 54, the first air pipe 2210, the fourth air pipe 2240 and the pipe line 57 to the air bladders 92. The air originally in the air bladders 94 flows to the small air chamber 116 via the pipe line 53 and the air pipe 1241 for discharging through the discharge hole 1160. While the air originally in the air bladders 93 flows to the small air chamber 116 via the pipe line 56 and the second air pipe 2220, the third air pipe 2230, the pipe line 55 and the lower air pipe 1243 for discharging through the discharge hole 1160. Hence the first one-side aeration state is provided, and a person lying on the bed can lie on one side of him.

Figure 10:
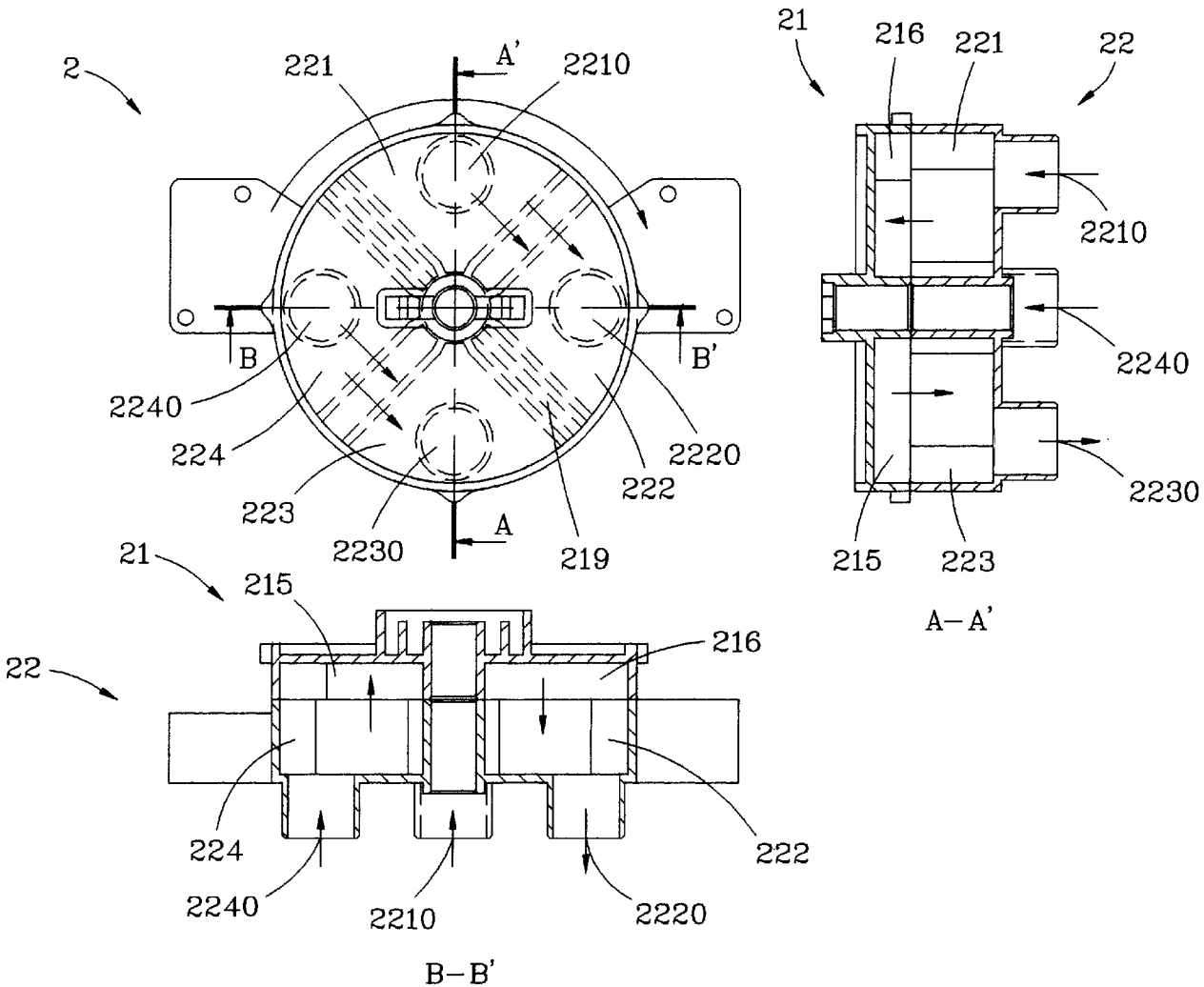
FIG. 10 is a schematic view showing the state of the second air valve in a first alternate aeration of the air bed of the present invention.
Figure 11:
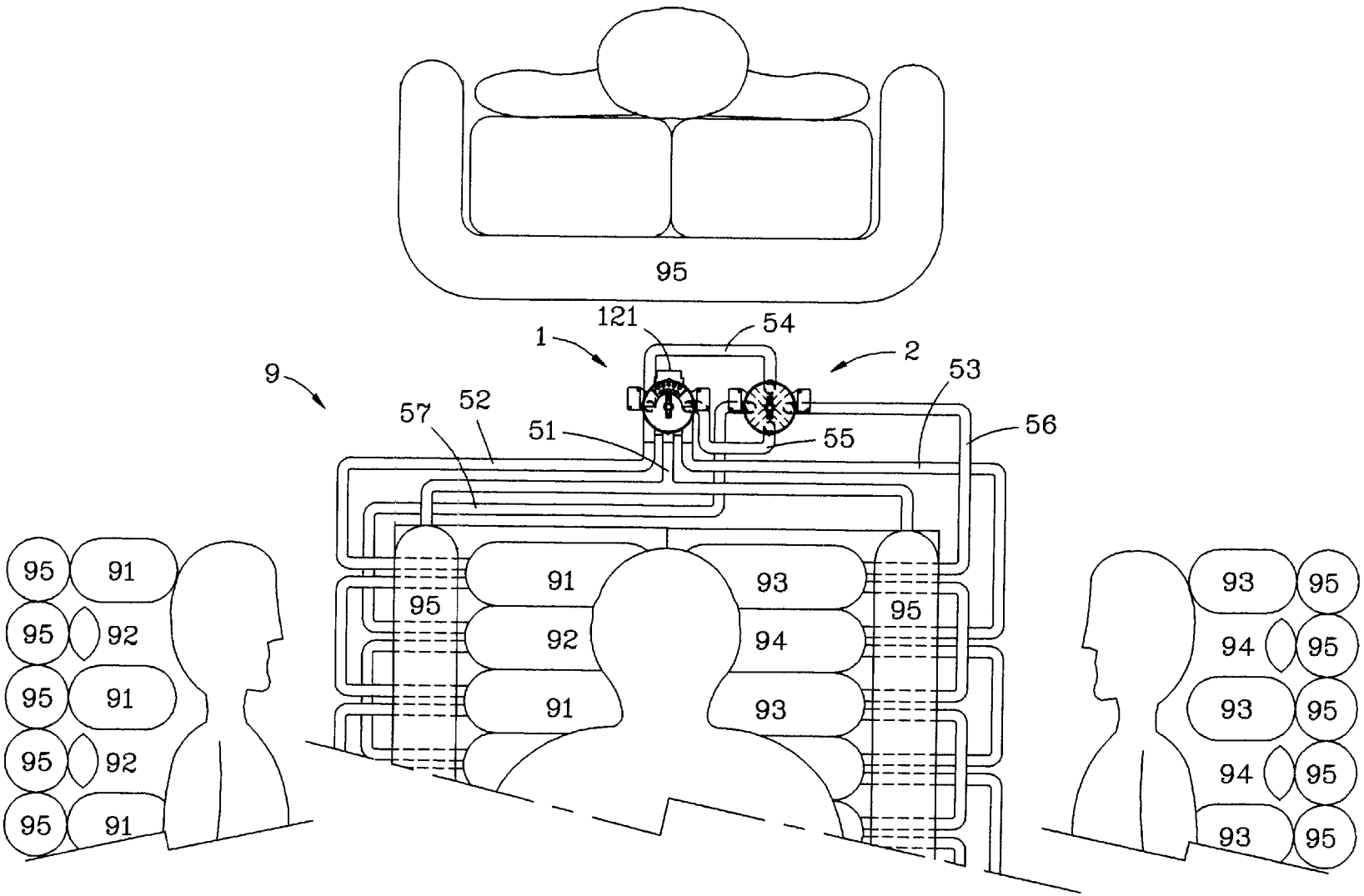
FIG. 11 is a schematic view showing the state of the air bed in the first alternate aeration of the air bed of the present invention.

When it is desired to provide the air bed with the first alternate aeration state: Referring to FIG. 7 and 10, air for the first air valve 1 is taken in from the main intake 121, and flows through the annular air chamber 122 to the big air chamber 115. Then the air gets into the air pipe 1251 and the lower air pipe 1253, through the pipe line 52 to aerate the air bladder 91. And flows into the air pipe 1253, the pipe line 54, the first air chamber 221, the second air chamber 222, the pipe line 56 and the air bladders 93. Air in the air bladders 92, in pursuance of the structure of the second air valve 2, is discharged via the pipe line 57, the fourth air pipe 2240, the fourth air chamber 224, the third air chamber 223, the third air pipe 2230, the pipe line 55, the lower air pipe 1243, the air chamber 1242, the small air chamber 116 and the discharge hole 1160. While air in the air bladders 94 is discharged via the pipe line 53, the air pipe 1241, the air chamber 1242, the small air chamber 116 and the discharge hole 1160. In this way, the air bladders 91, 93 are aerated, while the air bladders 92, 94 are discharged, that is to say, the air bed 9 is in the first alternate aeration state (as shown in FIG. 11).

Figure 12:
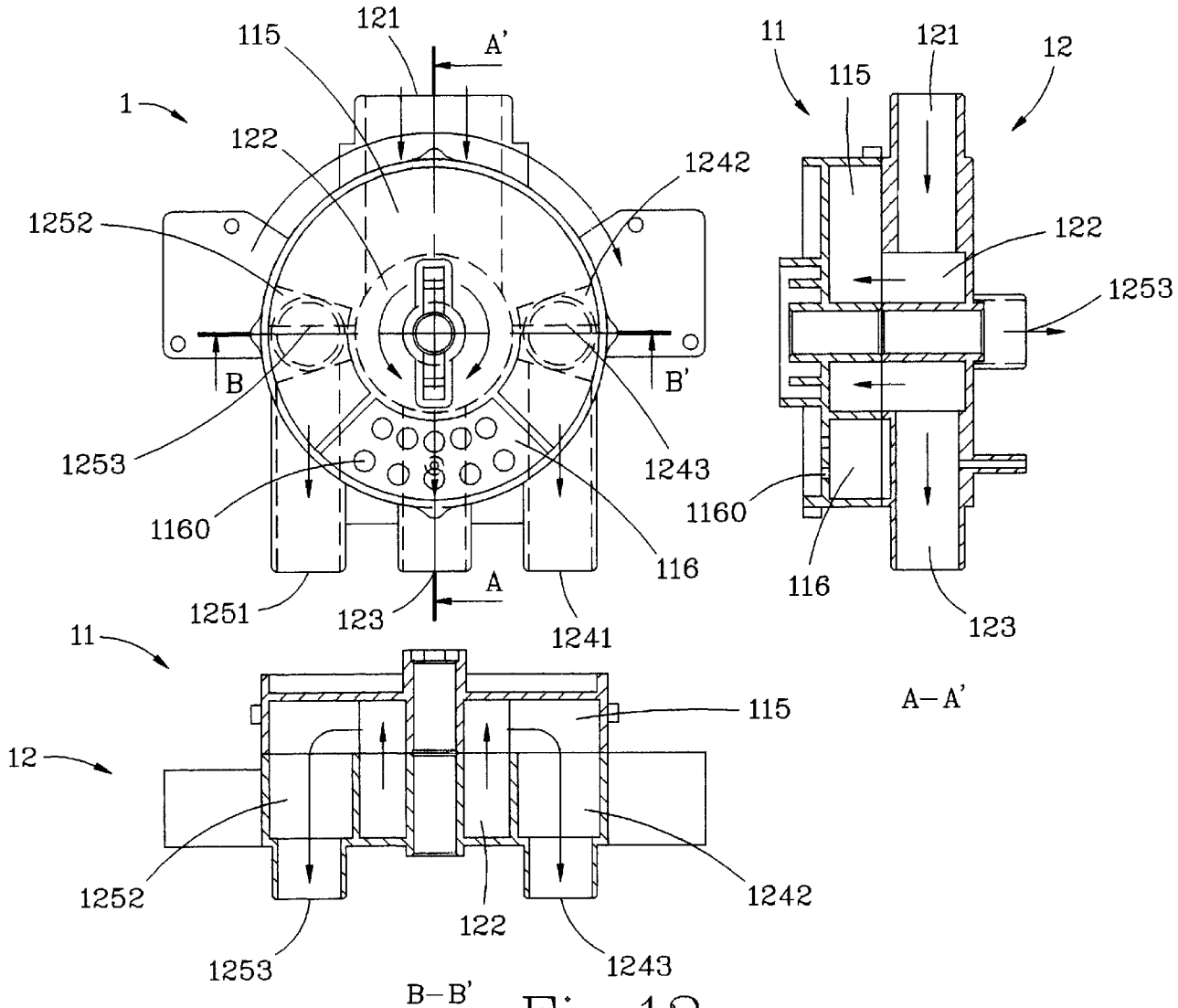
FIG. 12 is a schematic view showing the state of the first air valve after being rotated.

FIG. 12 is a schematic view showing the state of the first air valve 1 after being rotated, the function of air bed 9 is the same as that when in the state of FIG. 4.

Figure 13:
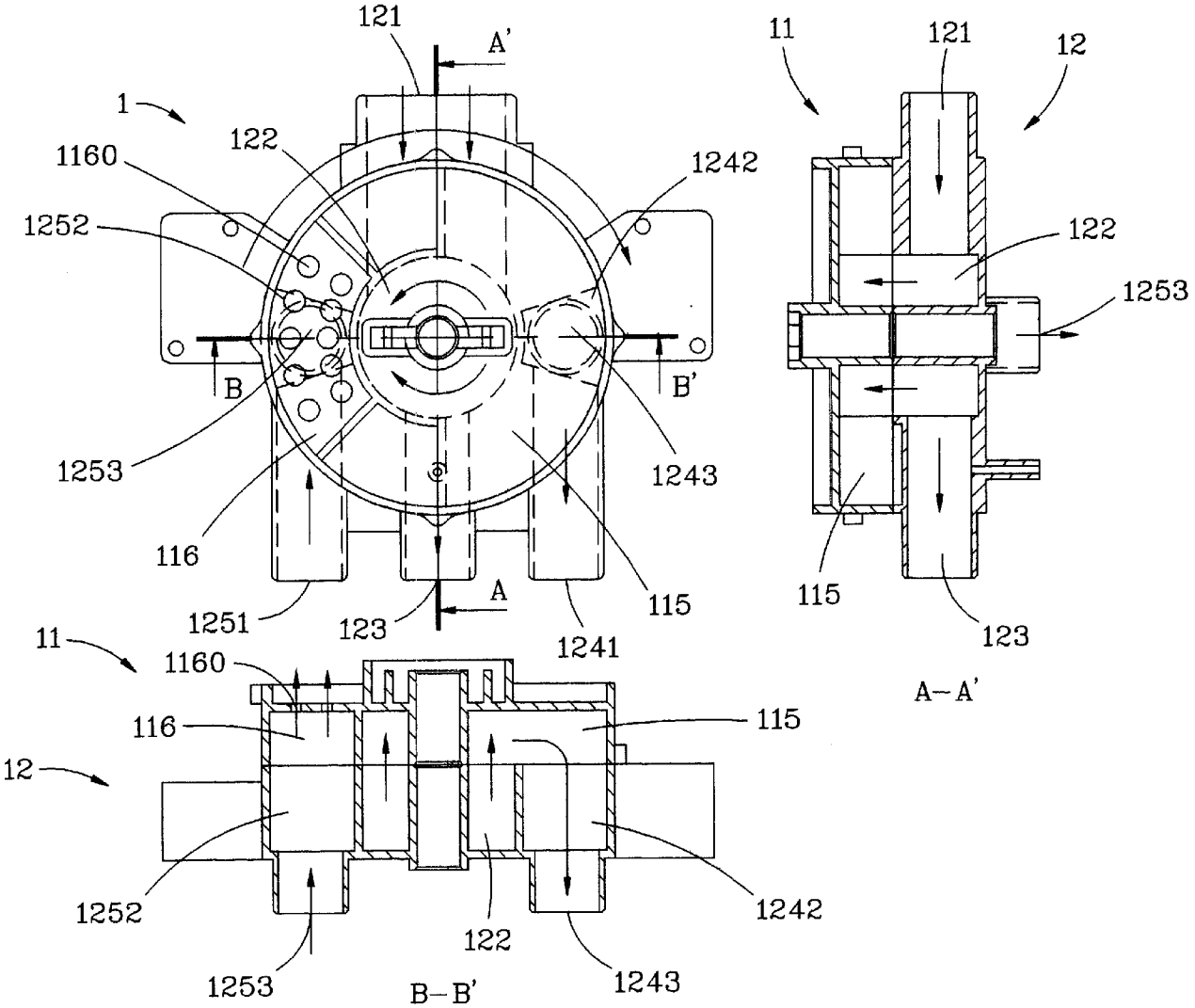
FIG. 13 is a schematic view showing the state of the first air valve in a second alternate aeration of the air bed of the present invention.
Figure 14:
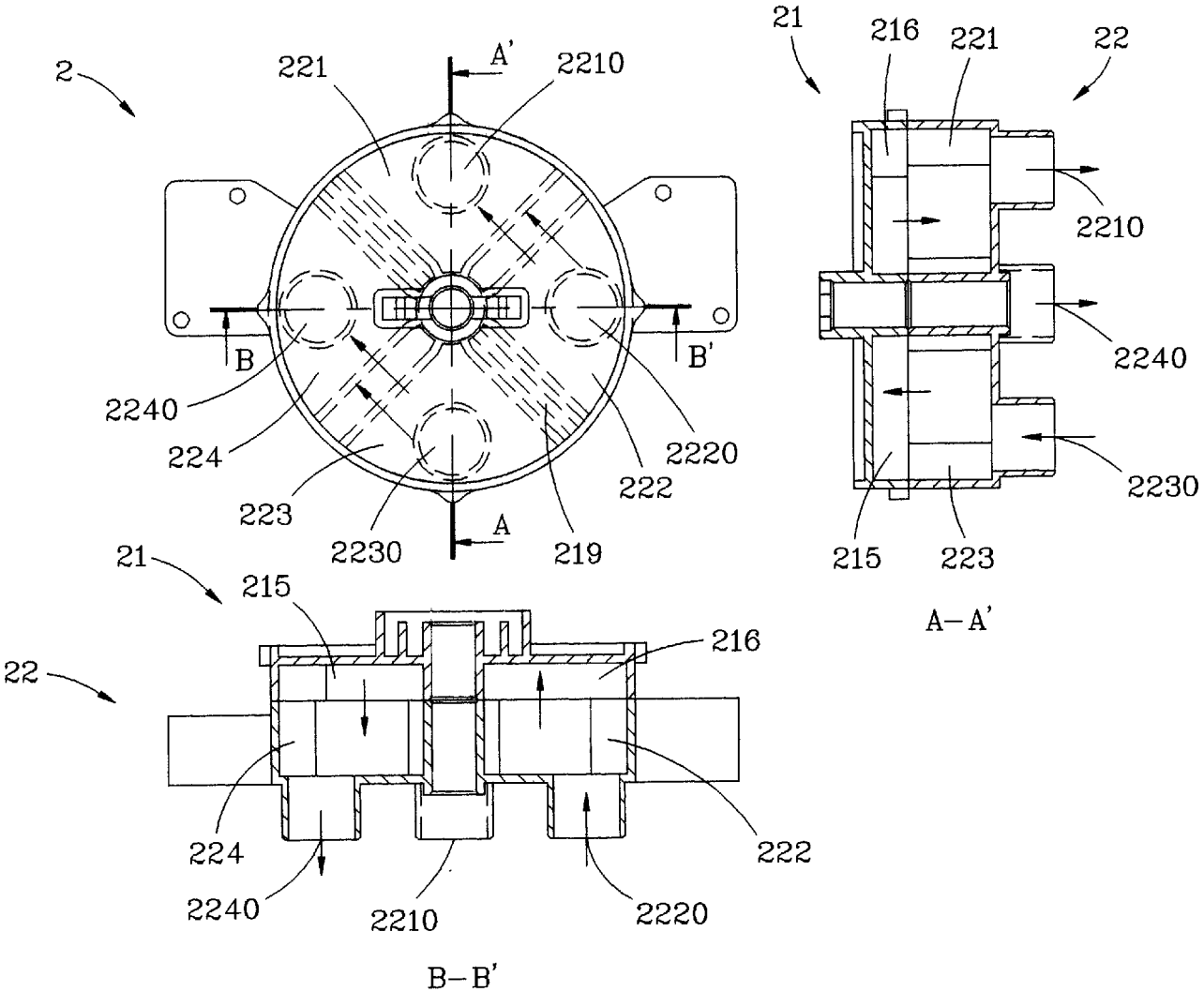
FIG. 14 is a schematic view showing the state of the second air valve in the second alternate aeration of the air bed of the present invention.
Figure 15:
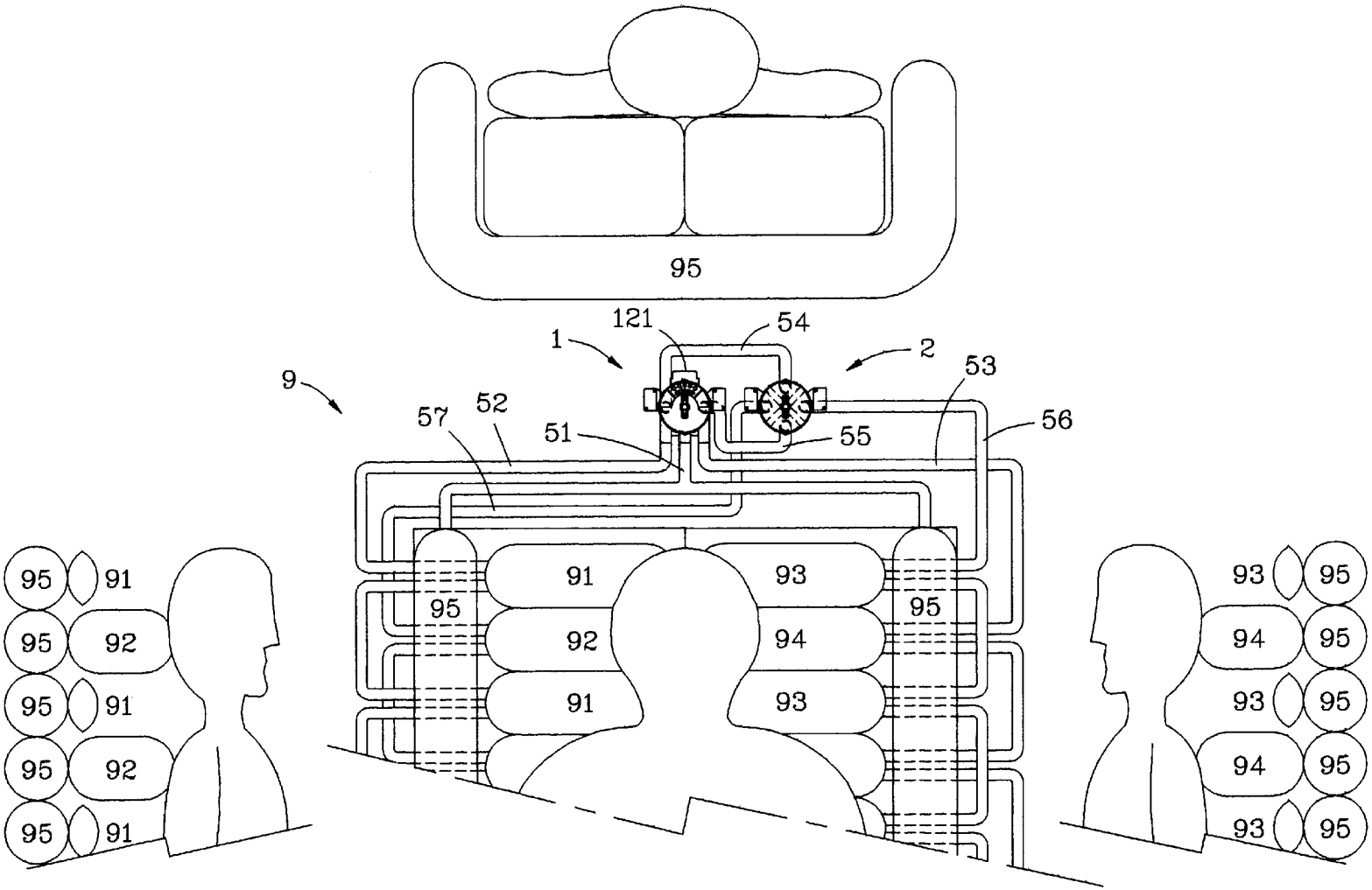
FIG. 15 is a schematic view showing the state of the air bed in the second alternate aeration of the air bed of the present invention.

As shown in FIG. 13, 14 which are schematic views showing the states of the air valves in aeration of the air bladders 92, 94 and in discharging of air bladders 91, 93 of the air bed of the present invention. Wherein, the air chamber 1242, the air pipe 1241, the lower air pipe 1243, the pipe line 53 and the air bladders 94 are filled with air. And the lower air pipe 1243, the pipe line 55, the third air chamber 223, the fourth air chamber 224, the pipe line 57 and the air bladders 92 are filled with air. While the air bladders 91 are discharged by means of the air chamber 1252 which is communicated with the small air chamber 116 and the discharge hole 1160. Air in the air bladders 93 is discharged via the pipe line 56, the second air pipe 2220, the second air chamber 222, the air chamber 216, the first air chamber 221, the first air pipe 2210, the pipe line 54, the air pipe 1253 and the air chamber 1252. And this forms the second alternate aeration state as shown in FIG. 15.

Figure 16:
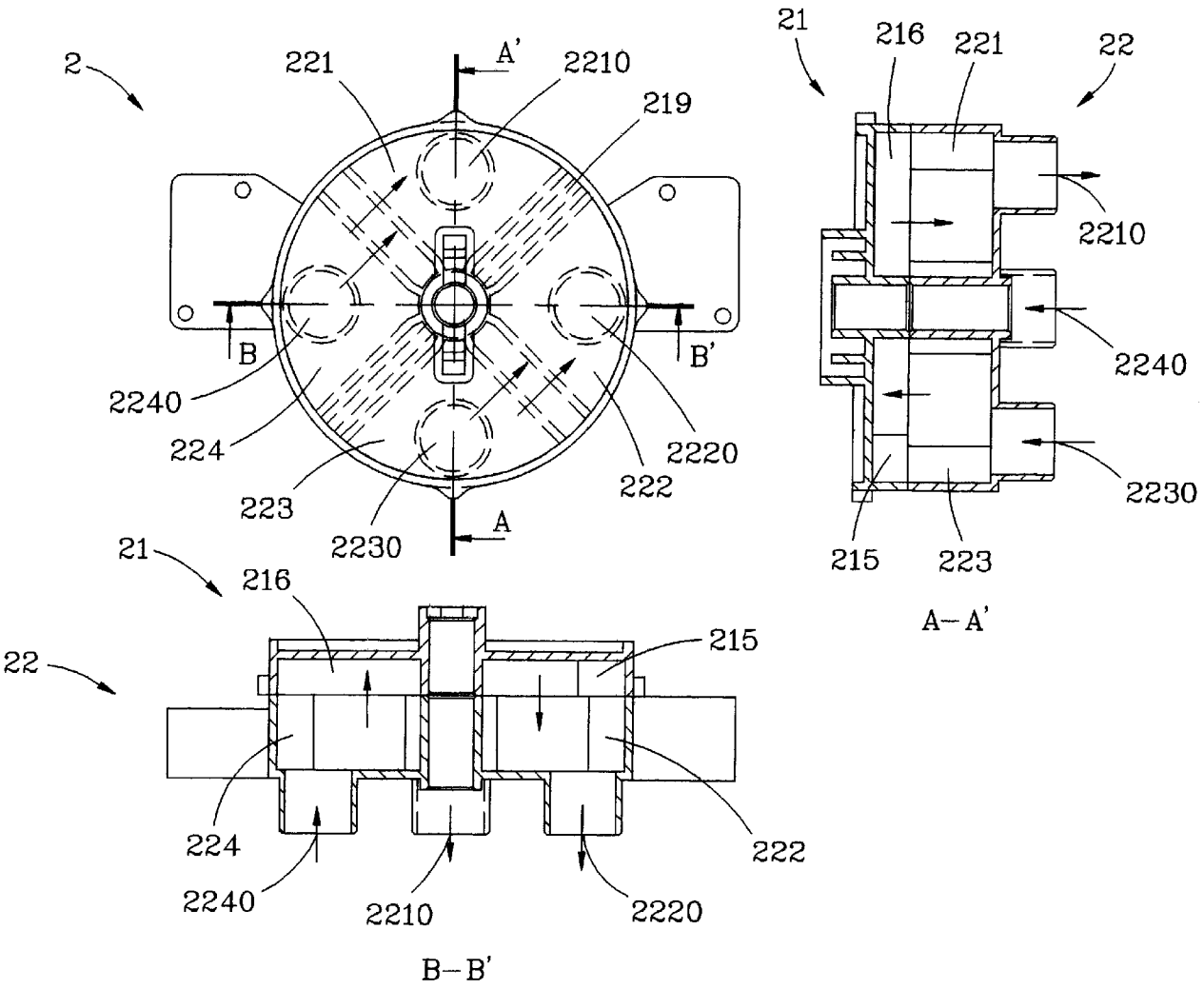
FIG. 16 is a schematic view showing the state of the second air valve in a second one-side aeration of the air bed of the present invention.
Figure 17:
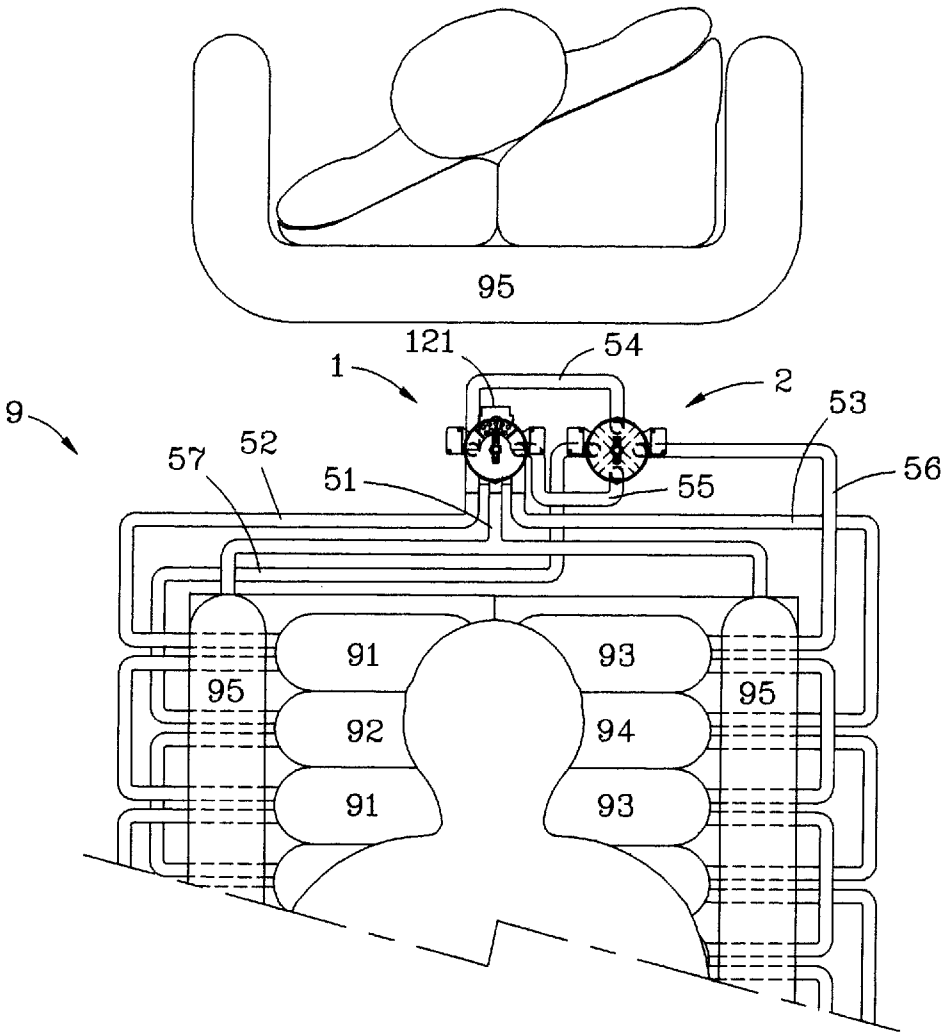
FIG. 17 is a schematic view showing the state of the air bed in the second one-side aeration of the air bed of the present invention.

FIG. 13 and 16 show the states of the air valves in the first one-side aeration of the air bladders 93, 94 and in discharging of air bladders 91, 92 of the air bed of the present invention. Wherein, air is taken in from the main intake 121, and flows through the annular air chamber 122 to the big air chamber 115. Then the air gets into the air pipe 1241, the lower air pipe 1243, the pipe line 53 and the air bladders 94. And the lower air pipe 1243, the pipe line 55, the third air chamber 223, the second air chamber 222, the pipe line 56 and the air bladders 93 are aerated. Air in the air bladders 92 originally, in pursuance of the structure of the second air valve 2, is discharged via the pipe line 57, the fourth air pipe 2240, the fourth air chamber 224, the first air chamber 221, the first air pipe 2210, the pipe line 54, the lower air pipe 1253, the air chamber 1252 the small air chamber 116 and the discharge hole 1160 (as shown in FIG. 17).

When in practice of the present invention, a user can use micro-switches taking advantage of the electronic circuits of the present invention depending on the states of contact of the lugs 111, 112, 113 and 114 as well as the lugs 211, 212, 213 and 214 with the micro-switches 31, 32, 33 and the micro-switch 41, 42, to get a state of aeration and discharging by himself without observing the above described sequences of aeration and discharging.

In conclusion, the air bed structure capable of alternate aerating and lying thereon on one's side is the first one achieving all the functions of complete aeration, first one-side aeration, second one-side aeration, first alternate aeration and second alternate aeration etc. among the products of such kind. It effectively gets rid of the conventional defects, and therefore is practical and improved. Such effect can not be achieved with any product existed in the markets. The product of the present invention has never disclosed in a document nor has existed in the markets and hence is outstanding.

Having thus described my invention, what I claim as new and desire to be secured by Letters Patent of the United States are:

What is claimed is:

1. An air bed structure comprising:

a first air valve, a second air valve and an air bed; wherein, said first air valve is comprised of an upper rotation lid and a lower seat, said upper rotation lid is mounted on said lower seat, said upper rotation lid and said lower seat each include at a central portion a through hole, a driving structure is provided on a top of said upper rotation lid, said driving structure includes an external motor that drives said upper rotation lid to rotate, while said lower seat maintains unmoved, a top surface of said upper rotation lid is a sealed surface, a big air chamber and a small air chamber are formed beneath said top surface, two blocks are provided between said air chambers, the top of said small air chamber is provided with a plurality of discharge holes, said upper rotation lid is provided on an external annular wall thereof with a plurality of lugs, said lower seat is provided on a wall with a transverse main intake, said lower seat is provided beneath the top surface thereof with an annular air chamber which is in communication with said transverse main intake, a transverse central discharge pipe is provided on an external wall of said lower seat opposite said transverse main intake and is in communication with said annular air chamber, said transverse central discharge pipe is provided at two sides thereof with a first and a second air pipe respectively, while said annular air chamber is provided at both sides thereof with an air chamber which is opened on its top, said air chambers at said sides of said annular air chamber are provided on bottoms thereof with a first and a second lower air pipe respectively, said first lower air pipe is in communication with an interior of said first air pipe, said second lower air pipe is in communication with an interior of said second air pipe, said air chambers of said lower seat are provided respectively at outer lateral sides thereof with a receiving seat that receives a plurality of micro-switches and a pad;

said second air valve is comprised of an upper rotation lid and a lower seat, said upper rotation lid is mounted on said lower seat, said upper rotation lid and said lower seat each include at a central portion a through hole, a driving structure is provided on a top of said upper rotation lid, said driving structure includes an external motor that drives said upper rotation lid to rotate, while said lower seat maintains unmoved, a top surface of said upper rotation lid is a sealed surface, two air chambers are formed beneath said top surface, a block is provided between said two air chambers, said upper rotation lid is provided on the external annular wall thereof with a plurality of lugs, a bottom surface of said lower seat is a sealed surface, a top thereof is divided into a first air chamber, a second air chamber, a third air chamber and a fourth air chamber separated by a cross shaped partition plate, bottoms of said air chambers are provided respectively with a first air pipe, a second air pipe, a third air pipe and a fourth air pipe, said second air chamber and said fourth air chamber of said lower seat are provided respectively at outer lateral sides thereof with two receiving seats for mounting therein a plurality of micro-switches and a pad;

said air bed is comprised of a plurality of elongate air bladders, a first and a second set of said elongate air bladders are provided on a first side of said air bed, and a third and a fourth set of said elongate air bladders are provided on a second side of said air bed, a fifth elongate air bladder extends to both sides of said first, second, third and fourth sets of elongate air bladders and is situated above said first, second, third and fourth sets of elongate air bladders; wherein said main intake is connected to an external air supply pump, said central discharge pipe is connected to said fifth elongate air bladder via a first pipe line, said first air pipe on said first air valve is connected to said first set of elongate air bladders, said first lower air pipe is connected to said first air pipe of said first air chamber on said second air valve via a second pipe line, said second lower air pipe is connected to said third air pipe of said third air chamber on said second air valve via another a third pipe line, said second air pipe of said second air chamber on said second air valve is connected to said third set of elongate air bladders via a fourth pipe line, and said fourth air pipe of said fourth air chamber on said second air valve is connected to said second set of elongate air bladders via a fifth pipe line; such that a user can control rotation and rotating time of said upper rotation lids of said first and second air valves to obtain any of a plurality of aeration states comprising complete aeration, first one-side aeration, second one-side aeration, first alternate aeration and second alternate aeration of said air bed.

2. The air bed structure as stated in claim 1, wherein:

a rotating time of said upper rotation lid of said first air valve and a rotating time of said upper rotation lid of said second air valve is controlled with an electronic circuit.

* * * * *